US011199076B2

(12) United States Patent
Collins et al.

(10) Patent No.: US 11,199,076 B2
(45) Date of Patent: Dec. 14, 2021

(54) SHAPED CHARGE RETAINING DEVICE

(71) Applicant: Hunting Titan, Inc., Pampa, TX (US)

(72) Inventors: William R. Collins, Burleson, TX (US); Shane Matthew Wilson, Waxahachie, TX (US)

(73) Assignee: Hunting Titan, Inc., Pampa, TX (US)

( * ) Notice: Subject to any disclaimer, the term of this patent is extended or adjusted under 35 U.S.C. 154(b) by 450 days.

(21) Appl. No.: 15/747,711

(22) PCT Filed: Aug. 5, 2016

(86) PCT No.: PCT/US2016/045880
§ 371 (c)(1),
(2) Date: Jan. 25, 2018

(87) PCT Pub. No.: WO2017/024266
PCT Pub. Date: Feb. 9, 2017

(65) Prior Publication Data

US 2018/0216445 A1 Aug. 2, 2018

Related U.S. Application Data

(60) Provisional application No. 62/201,868, filed on Aug. 6, 2015.

(51) Int. Cl.

| | |
|---|---|
| ***E21B 43/117*** | (2006.01) |
| ***E21B 43/119*** | (2006.01) |
| ***F42B 3/08*** | (2006.01) |
| ***E21B 43/116*** | (2006.01) |

(52) U.S. Cl.
CPC ..... *E21B 43/117* (2013.01); *E21B 43/116* (2013.01); *E21B 43/119* (2013.01); *F42B 3/08* (2013.01)

(58) Field of Classification Search
CPC .... E21B 43/116; E21B 43/117; E21B 43/119; E21B 3/08
See application file for complete search history.

(56) References Cited

U.S. PATENT DOCUMENTS

| | | | | |
|---|---|---|---|---|
| 3,094,930 A | | 6/1963 | Blair | |
| 3,468,386 A | | 9/1969 | Johnson | |
| 4,817,531 A | * | 4/1989 | Walker | E21B 43/117 102/306 |
| 4,832,134 A | * | 5/1989 | Gill | E21B 43/117 102/310 |

(Continued)

FOREIGN PATENT DOCUMENTS

| | | |
|---|---|---|
| EP | 0352947 A2 | 1/1990 |
| GB | 2350149 B | 5/2001 |

OTHER PUBLICATIONS

Notification of Transmittal of the International Search Report and the Written Opinion of the International Searching Authority, PCT Application No. PCT/US2016/045880, dated Oct. 14, 2016, 9 pages.

(Continued)

*Primary Examiner* — Christopher J Sebesta
(74) *Attorney, Agent, or Firm* — Christopher McKeon; Jason Saunders; Arnold & Saunders, LLP

(57) ABSTRACT

An apparatus and method for connecting a shaped charge retainer to a shaped charge and connecting that to a charged tube in a perforating gun for use downhole.

21 Claims, 4 Drawing Sheets

(56) References Cited

U.S. PATENT DOCUMENTS

| | | | | | |
|---|---|---|---|---|---|
| 5,673,760 | A * | 10/1997 | Brooks | E21B 43/117 175/4.6 |
| 5,829,538 | A * | 11/1998 | Wesson | E21B 43/117 175/4.6 |
| 5,862,758 | A | 1/1999 | Parrott | |
| 5,952,603 | A * | 9/1999 | Parrott | E21B 43/117 102/312 |
| 2003/0121442 | A1 | 7/2003 | Gilbert, Jr. et al. | |
| 2010/0011945 | A1* | 1/2010 | Loehr | F42B 1/02 89/1.151 |
| 2011/0155381 | A1* | 6/2011 | Reaux | E21B 34/10 166/334.1 |
| 2013/0019770 | A1 | 1/2013 | Walker | |
| 2013/0056269 | A1* | 3/2013 | Xu | E21B 43/117 175/2 |

OTHER PUBLICATIONS

Supplementary European Search Report, EP16833965, dated Mar. 5, 2019, 7 pages.
Office action, Canadian application No. 2,993,990, dated Nov. 2, 2018, 3 pages.
Response to Office action, Canadian application No. 2,993,990, dated Dec. 10, 2018, 10 pages.

* cited by examiner

SHAPED CHARGE RETAINING DEVICE

RELATED APPLICATIONS

This application claims priority to U.S. Provisional Application No. 62/201,868, filed Aug. 6, 2015.

FIELD

This disclosure generally relates to perforating guns used in a subterranean environment such as an oil or gas well. More particularly, it relates to fittings and retainers that aligns the detonating cord with a shaped charge installed in a charge tube. The embodiments disclosed have a retainer feature which allows for simplified installation with existing shaped charges and detonating cord.

BACKGROUND

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock.

A perforating gun has a gun body. The gun body typically is composed of metal and is cylindrical in shape. Within a typical gun tube is a charge holder or carrier tube, which is a tube that is designed to hold the actual shaped charges. The charge holder will contain cutouts called charge holes where the shaped charges will be placed.

A shaped charge is typically detonated by a booster or igniter. Shaped charges may be detonated by electrical igniters, pressure activated igniters, or detonating cord. One way to ignite several shaped charges is to connect a common detonating cord that is placed proximate to the igniter of each shaped charge. The detonating cord is comprised of material that explodes upon ignition. The energy of the exploding detonating cord can ignite shaped charges that are properly placed proximate to the detonating cord. Often a series of shaped charges may be daisy chained together using detonating cord.

SUMMARY OF EXAMPLE EMBODIMENTS

In order to detonate a shaped charge in a perforating gun a continuous detonating cord is placed adjacent to each shaped charge. Holding a shaped charge in place is crucial to ensuring that all of the shaped charges detonate correctly and in the precise orientation. A shaped charge retainer device can be fastened to the end of the shaped charge and interface with keyed cutouts on a charge tube to lock the shaped charge into place.

An example embodiment may include a shaped charge retainer having a bottom ring section, being substantially cylindrical about an axis and having a first internal diameter, a top section, being substantially cylindrical about the axis, having a second internal diameter smaller than the first internal diameter, and being attached to and axially displaced from the bottom ring section, a first key protruding radially from the bottom ring section, and a first locking tab protruding radially from the top section, located above the first key and offset a first twist angle about the axis from the first key. The example may also include a second key protruding radially from the bottom cylindrical ring section and located axially about the axis. The example may also include a second locking tab protruding radially from the top section and located axially about the axis. The example may also include the shaped charge retainer being composed of zytel. The example may also include the locking tab having a bridge portion, a tab portion, wherein the bridge portion is shorter than the tab in dimension parallel to the axis. The example may also include the locking tab having a flush top surface adapted to be flush with a perforating charge tube. The example may also include the top section being frusto conical shaped. The example may also include the second key being located 180 degrees axially about the axis from the first key. The example may also include the second locking tab being located 180 degrees axially about the axis from the first locking tab. The example may also include a second key and a third key protruding radially from the bottom cylindrical ring section and located axially about the axis. The example may also include a second locking tab and a third locking tab protruding radially from the top section and located axially about the axis. The example may also include the first key, second key, and third key being located 120 degrees axially about the axis from each other. The example may also include the first locking tab, second locking tab, and third locking tab being located 120 degrees axially about the axis from each other.

Another example embodiment may include a method for installing at least one shaped charge including placing a shaped charge retainer having a plurality of keys on a shaped charge opening, inserting the shaped charge with the shaped charge retainer into a charge tube cutout, aligning the shaped charge retainer having a plurality of keys with a plurality of keyways in the charge tube, passing a plurality of keys on the shaped charge retainer through the plurality of keyways on the charge tube cutout, rotating the shaped charge retainer after passing the plurality of keys through the plurality of corresponding keyways, snapping a plurality of locking tabs located on the shaped charge retainer into the plurality of keyways. The example may include placing a u-shaped detonation cord retainer on the distal end of the shaped charge. The example may include attaching a detonation cord to the shaped charge. The example may include the at least one shaped charge being a plurality of shaped charges being installed in a single charge tube. The example may include installing the charge tube into a perforating gun. The example may include running the perforating gun to a predetermined downhole location. The example may include detonating the at least one shaped charge.

Another example embodiment may include a shaped charge retention system having a shaped charge case with an apex end and an explosive discharge end, a charge tube with a center axis, having a first plurality of circular cutouts adapted for interfacing with a shaped charge case apex end and a second plurality of circular cutouts located 180 degrees opposite of the first plurality of cutouts about the charge tube axis, a detonating cord, a shaped charge retainer including a bottom ring section, being substantially cylindrical about the axis and having a first internal diameter, a top section, being substantially cylindrical about the axis, having a second internal diameter smaller than the first internal diameter, and being attached to and axially displaced from the bottom ring section, a first key protruding radially from the bottom ring section, and a first locking tab protruding radially from the top section, located above the first key and offset a first twist angle about the axis from the first key. The example may include a second key protruding radially from the bottom cylindrical ring section and located axially about the axis. The example may include a second locking tab protruding radially from the top section and located axially about the axis. The example may include the shaped charge retainer being composed of zytel. The example may include the locking tab having a bridge portion, a tab portion, in which the bridge portion is shorter than the tab in dimension parallel to the axis. The example may include the locking tab having a flush top surface adapted to be flush with a perforating charge tube. The example may include the top section being frusto conical shaped. The example may include the second key being located 180 degrees axially about the axis from the first key. The example may include the second locking tab being located 180 degrees axially about the axis from the first locking tab. The example may include a second key and a third key protruding radially from the bottom cylindrical ring section and located axially about the axis. The example may include a second locking tab and a third locking tab protruding radially from the top section and located axially about the axis. The example may include the first key, second key, and third key being located 120 degrees axially about the axis from each other. It may include the first locking tab, second locking tab, and third locking tab being located 120 degrees axially about the axis from each other. It may include the shaped charge retainer being composed of plastic. It may include the shaped charge retainer pivoting about the shaped charge in 360 degrees. It may include a plurality of shaped charges. It may include a plurality of cylindrical retainers.

DESCRIPTION OF THE DRAWINGS

For a thorough understanding of the present disclosure, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE EMBODIMENTS

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
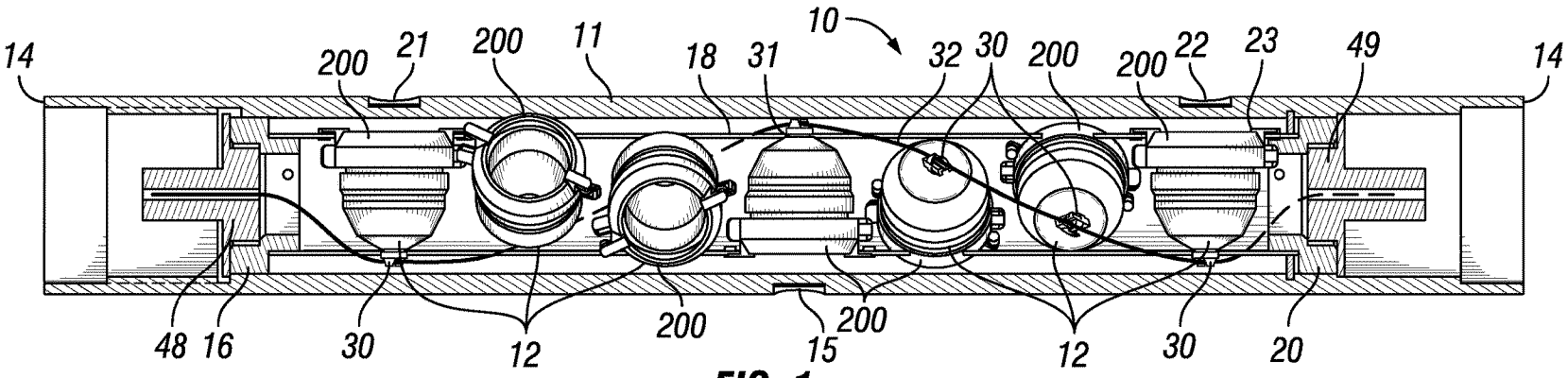
FIG. 1 is a side cross sectioned view of a perforating gun.

Referring to an example shown in FIG. 1, a typical perforating gun 10 comprises a gun body 11 that houses the shaped charges 12. The gun body 11 contains end fittings 16 and 20 which secure the charge holder 18 into place. The charge tube 18 in this example has charge holes 23 that are openings where shaped charges 12 may be placed. The charge holder 18 has retainer cutouts 31 that are adapted to fit a retainer fitting 30 in a predetermined orientation. Scallops 15, 21, and 22 provide a flat surface on the gun body 11 for the explosive charge to penetrate through. The gun body 11 has threaded ends 14 that allow it to be connected to a series of perforating guns 10 or to other downhole equipment depending on the job requirements. In this example, the retainer fitting 30 is separate from the charge holder 18, however in another variation of the embodiment, the retainer fitting 30 may be integral to the charge holder 18. Each shaped charge 12 has an associated retainer fitting 30 that secures each shaped charge 12 to the charge holder 18 and the detonating cord 32. The detonating cord 32 runs the majority of the length of the gun body 11 beginning at end cap 48 and ending at end cap 49. The detonating cord 32 wraps around the charge holder 18 as shown to accommodate the different orientations of the shaped charges 12. Each shaped charge 12 has a shaped charge retainer device 200 attached at the open end of the shaped charge. In this embodiment, the shaped charges 12 have an orientation that is rotated 60 degrees about the center axis of the gun body 11 from one shaped charge to the next. Other orientations may have zero angle, where all of the shaped charges 12 are lined up. Other orientations may have different angles between each shaped charge 12. This example using a 60 degree phase is illustrative and not intended to be limiting in this regard.

Figure 2:
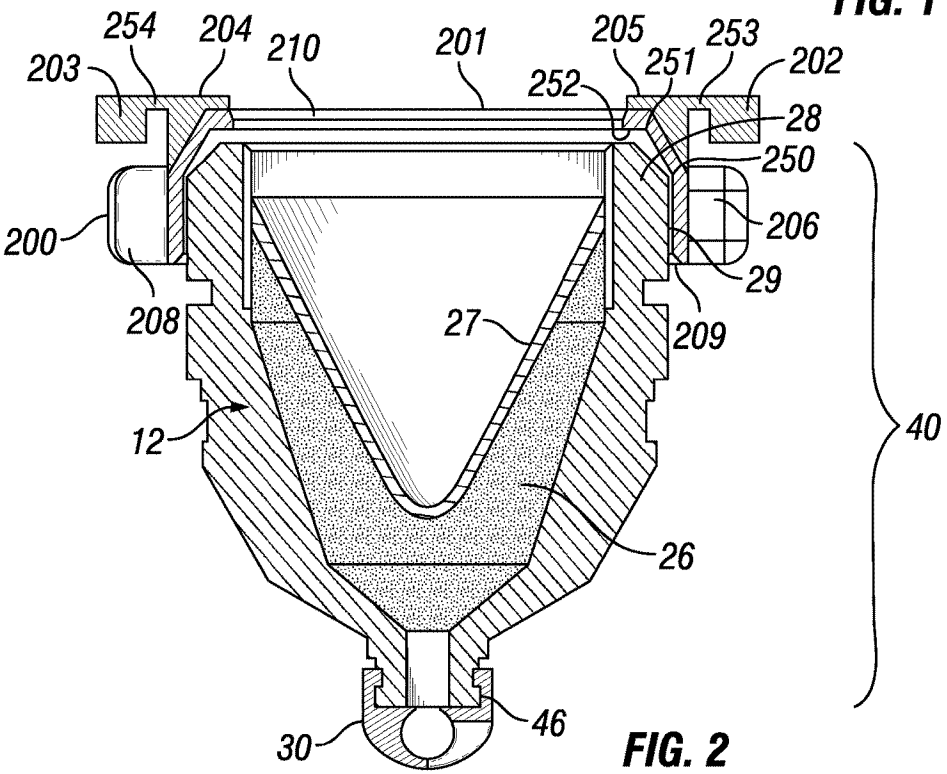
FIG. 2 is a side cross sectioned view of a shaped charge that may be used in a perforating gun with a locking device attached.

Referring to an example shown in FIG. 2, the shaped charges 12 includes a shaped charge case 28 that holds the energetic material 26 and the liner 27. The shaped charge case 28 typically is composed of a high strength metal, such as alloy steel. The liner 27 is usually composed of a powdered metal that is either pressed or stamped into place. The metals used in liner 27 may include brass, copper, tungsten, and lead. The retainer fitting 30 is secured to the apex end 46 of the shaped charge case 28 by snapping into place over a flange on apex end 46. The entire assembly 40 includes shaped charge 12 combined with retainer fitting 30. Alternatively, the retainer fitting 30 could be threaded onto the shaped charge case 28, secured with adhesive, snapped around the full length of the charge case, or formed integrally with the charge case. The fitting 30 could also be secured to the charge case 18 using set screws, roll pins, or any other mechanical attachment mechanisms. Alternatively, shaped charge case 28 could be integrally formed to retainer fitting 30. This would result in a single component, thus reducing cost and complexity.

Continuing to refer to FIG. 2, the shaped charge 12 has a shaped charge retainer device 200 attached to the open end. The shaped charge retainer device 200 has a top body portion 201 with a substantially frusto-conical shape. It has a bottom body portion 209 with a substantially cylindrical shape. It has a first alignment tab 208 protruding tangentially from the surface of the bottom body portion 209. It has a second alignment tab 206 protruding tangentially from the surface of the bottom body portion 209. It has a first locking tab 203 protruding from the top body portion 210. It has a second locking tab 202 protruding from the top body portion 210. The first locking tab has a flat top 204. The second locking tab 202 has a second flat top 205. The shaped charge retainer device 200 can be fixed to the outer surface 29 of the shaped charge case 28 by snapping into place, set screws, adhesives, or some other well known means for affixing two object together. The shaped charge retainer device 200 may also simply sit on top of the shaped charge case 28, either loosely or rely on the friction from an interference fit.

Continuing to refer to FIG. 2, the shaped charge retainer device 200 has a first inner diameter 250 and a second inner diameter 251. The first inner diameter 250 is larger than the second inner diameter 251 in this example, creating a chamfer in conjunction with shoulder 252. A bridge 254 connects the first locking tab 203 to the top body portion 210. A bridge 253 can connect the second locking tab 202 to the top body portion 210, this allows the locking tab to flex as it is rotated into position. A shoulder 252 may limit the axial movement of the shaped charge 12 when the shaped charge retainer device 200 is locked into place within a charge tube. The shaped charge retainer device 200 may be composed of plastic, nylon, zytel, zinc, or other commonly used materials.

Figure 3:
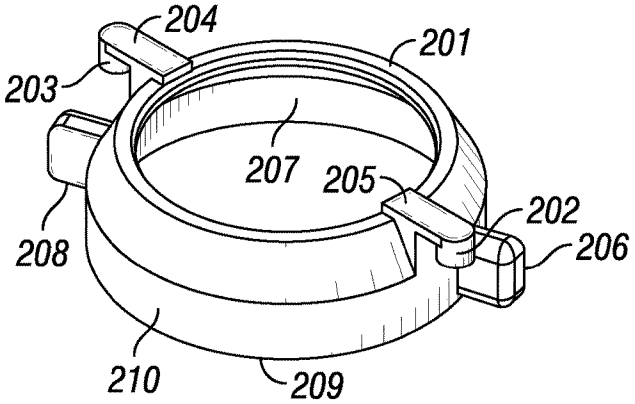
FIG. 3 is a detailed view of the locking device.

Refer to FIG. 3, the shaped charge retainer device 200 is shown from a perspective view without the shaped charge attached. The shaped charge retainer device 200 has a top body portion 201 with a substantially frusto-conical shape. It has a bottom body portion 209 with a substantially cylindrical shape. It has a first alignment tab 208 protruding tangentially from the surface of the bottom body portion 209. It has a second alignment tab 206 protruding tangentially from the surface of the bottom body portion 209. It has a first locking tab 203 protruding from the top body portion 210. It has a second locking tab 202 protruding from the top body portion 210. The first locking tab has a flat top 204. The second locking tab 202 has a second flat top 205. It has an inner surface 207.

Figure 4A:
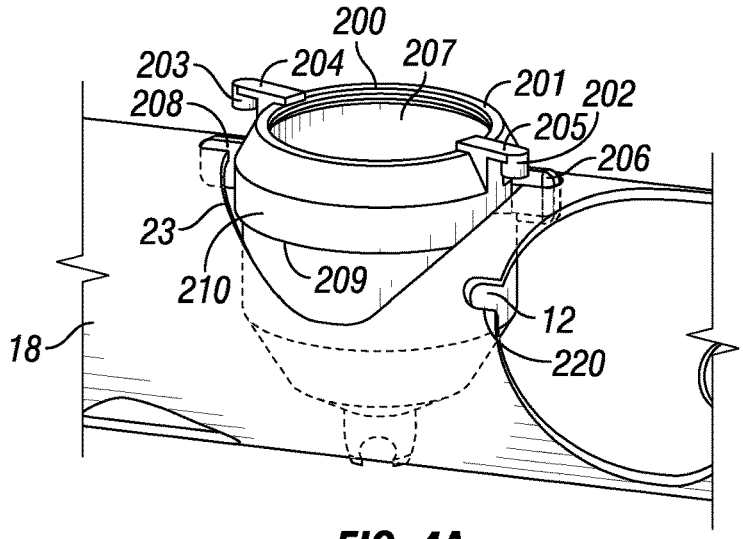
FIG. 4A is a view of a charge tube adapted for use with an example embodiment including a shaped charge with the locking device attached in the unlocked position.
Figure 4B:
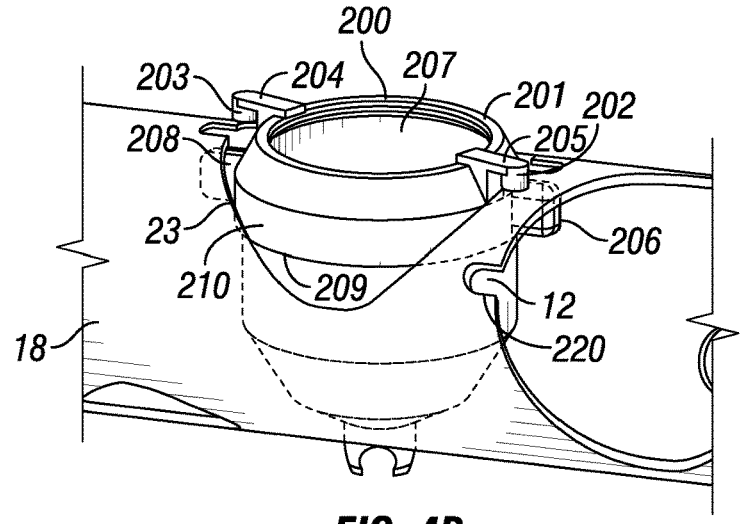
FIG. 4B is a view of a charge tube adapted for use with an example embodiment including a shaped charge with the locking device attached in the inserted and unlocked position.
Figure 4C:
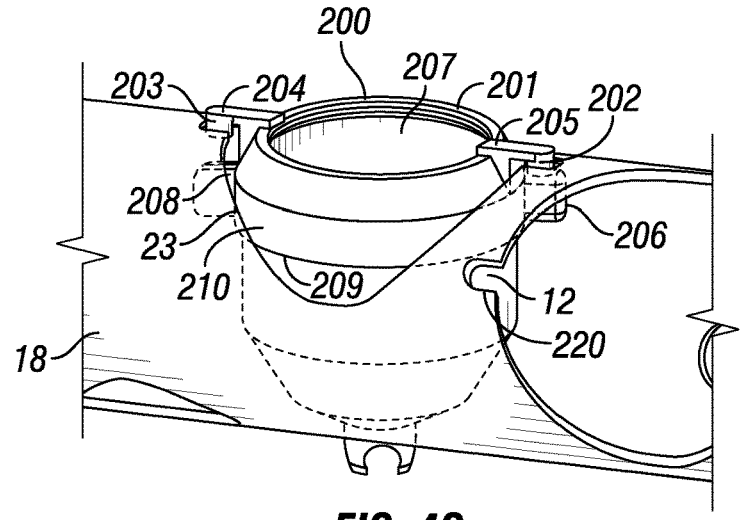
FIG. 4C is a view of a charge tube adapted for use with an example embodiment including a shaped charge with the locking device attached in the inserted and locked position.

The installation of the shaped charge 12 with the attached shaped charge retainer device is shown in FIGS. 4A-4C. Referring to an example shown in FIG. 4A, this is a detail drawing of the retainer of a shaped charge 12 with the shaped charge retainer device 200 attached as it is inserted into a charge tube 18. The shaped charge retainer device 200 has a top body portion 201 with a substantially frusto-conical shape. It has a bottom body portion 209 with a substantially cylindrical shape. It has a first alignment tab 208 protruding tangentially from the surface of the bottom body portion 209. It has a second alignment tab 206 protruding tangentially from the surface of the bottom body portion 209. It has a first locking tab 203 protruding from the top body portion 210. It has a second locking tab 202 protruding from the top body portion 210. The first locking tab has a flat top 204. The second locking tab 202 has a second flat top 205. It has an inner surface 207. The shaped charge 12 is inserted into a charge tube 18 via charge hole 23. The charge tube 18 has cutouts 220 that are shaped such that the first alignment tab 208 and the second alignment tab 206 can fit through the cutouts 220. The installation procedure involves inserting the first alignment tab 208 and second alignment tab 206 through the keyed cutouts 220, then twisting the shaped charge retainer 200 a predetermined amount of twist angle until the first locking tab 203 and second locking tab 202 engage the keyed cutout 220.

Referring to an example shown in FIG. 4B, this is a detail drawing of the retainer of a shaped charge 12 with the shaped charge retainer device 200 attached as it is inserted into a charge tube 18. The shaped charge retainer device 200 has a top body portion 201 with a substantially frusto-conical shape. It has a bottom body portion 209 with a substantially cylindrical shape. It has a first alignment tab 208 protruding tangentially from the surface of the bottom body portion 209. It has a second alignment tab 206 protruding tangentially from the surface of the bottom body portion 209. It has a first locking tab 203 protruding from the top body portion 210. It has a second locking tab 202 protruding from the top body portion 210. The first locking tab has a flat top 204. The second locking tab 202 has a second flat top 205. It has an inner surface 207. The shaped charge 12 is inserted into a charge tube 18 via charge hole 23. The charge tube 18 has cutouts 220 that are shaped such that the first alignment tab 208 and the second alignment tab 206 can fit through the cutouts 220. In this depiction the first alignment tab 208 and the second alignment tab 206 have passed through the cutouts 220. The shaped charge retainer device 200 can then be rotated in order to allow the first locking tab 203 and the second locking tab 202 to fit into cutouts 220.

Referring to an example shown in FIG. 4C, this is a detail drawing of the retainer of a shaped charge 12 with the shaped charge retainer device 200 attached as it is inserted into a charge tube 18. The shaped charge retainer device 200 has a top body portion 201 with a substantially frusto-conical shape. It has a bottom body portion 209 with a substantially cylindrical shape. It has a first alignment tab 208 protruding tangentially from the surface of the bottom body portion 209. It has a second alignment tab 206 protruding tangentially from the surface of the bottom body portion 209. It has a first locking tab 203 protruding from the top body portion 210. It has a second locking tab 202 protruding from the top body portion 210. The first locking tab has a flat top 204. The second locking tab 202 has a second flat top 205. It has an inner surface 207. The shaped charge 12 is inserted into a charge tube 18 via charge hole 23. The charge tube 18 has cutouts 220 that are shaped such that the first alignment tab 208 and the second alignment tab 206 can fit through the cutouts 220. In this depiction the first alignment tab 208 and the second alignment tab 206 have passed through the cutouts 220. The shaped charge retainer device 200 has been rotated and the first locking tab 203 and the second locking tab 202 fits into cutouts 220. The first flat surface 204 and second flat surface 205 may be substantially flush with the outer surface of charge tube 18.

Figure 5A:
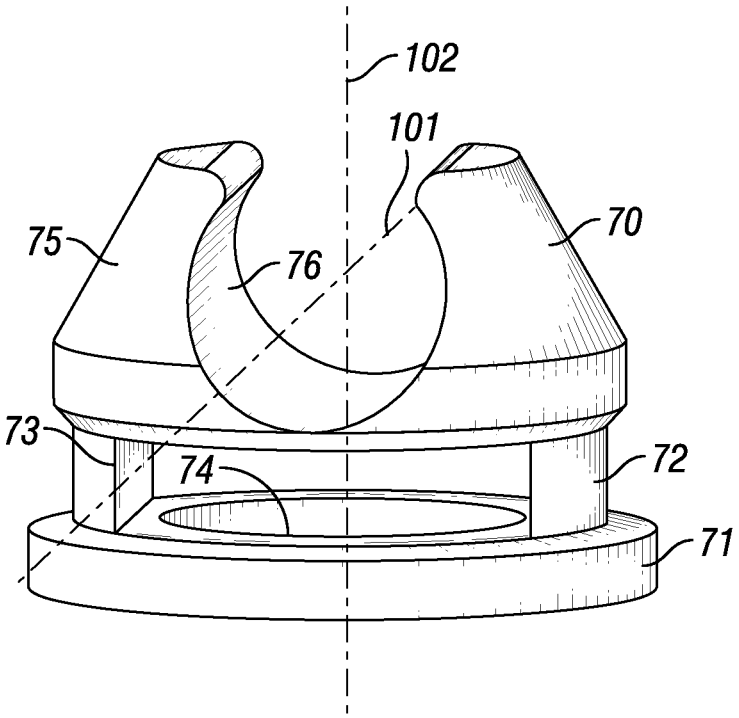
FIG. 5A is a perspective view of a detonating cord retainer.
Figure 5B:
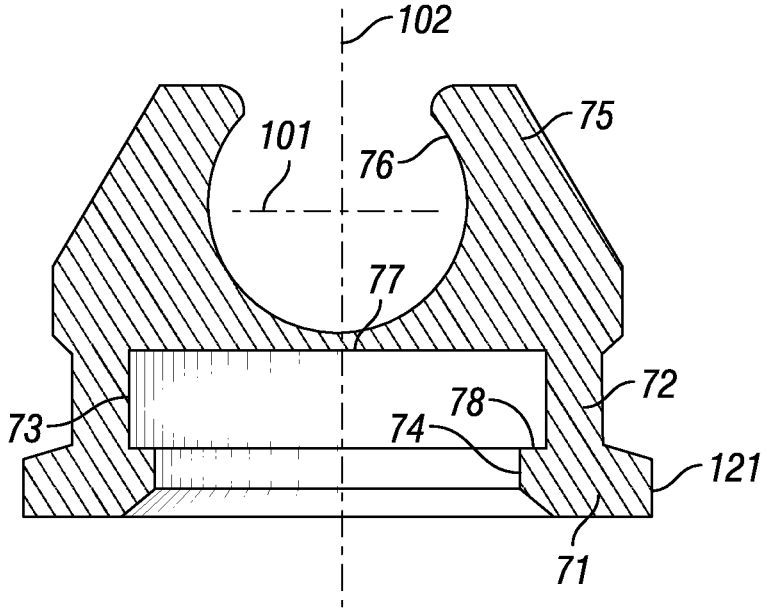
FIG. 5B is a cross-section view of a detonating cord retainer.

Another example embodiment is depicted in FIG. 5A and FIG. 5B. This detonating cord retainer 70 has a base 71 with a through hole 74, a middle portion 72 with a through slot 73, and a upper portion 75 that is shaped as a truncated conical with a u-shaped channel 76 that is sized to snap onto a detonating cord. The detonating cord retainer 70 has a first axis 102 aligning the base 71, middle portion 72, and upper portion 75. The u-shaped channel 76 also has an axis 101 that is perpendicular to the axis 102. The base 71 snaps onto the end of a shaped charge with the edge of the u-shaped channel 76 adapted to snap over a lip. The detonating cord retainer 70 can be secured to the shaped charge, but still rotate to its desired orientation in order to snap to a detonating cord. The u-shaped channel 76 is designed to securely snap onto a detonating cord and restrict the movement of the detonating cord. In this embodiment the detonating cord could explode through the thin material 77 between the u-shaped channel 76 and the thru slot 73, whereby the explosion would travel down the thru hole 74 and into the back of a shaped charge.

The thru slot 73 is perpendicular to axis 102. Furthermore, detonating cord retainer 70 has a base 71 that has a shoulder 121 capable of engaging the charge tube in such a way as to restrain the movement of the shaped charge along the axis 102, but allowing rotation about the axis 102. In the alternative, a thru hole or thru aperture could be located at 77 to facilitate explosive communication between the detonating cord and the shaped charge.

An alternative to the u-shaped channel 76 is a c-shaped cutout in which the channel 76 is rotated 90 degrees such that the detonating cord is accepted from the side rather than the top as shown. The shoulder 78 allows the retainer 70 to snap onto the apex end 60 of a shaped charge, as shown in FIG. 6.

Figure 6:
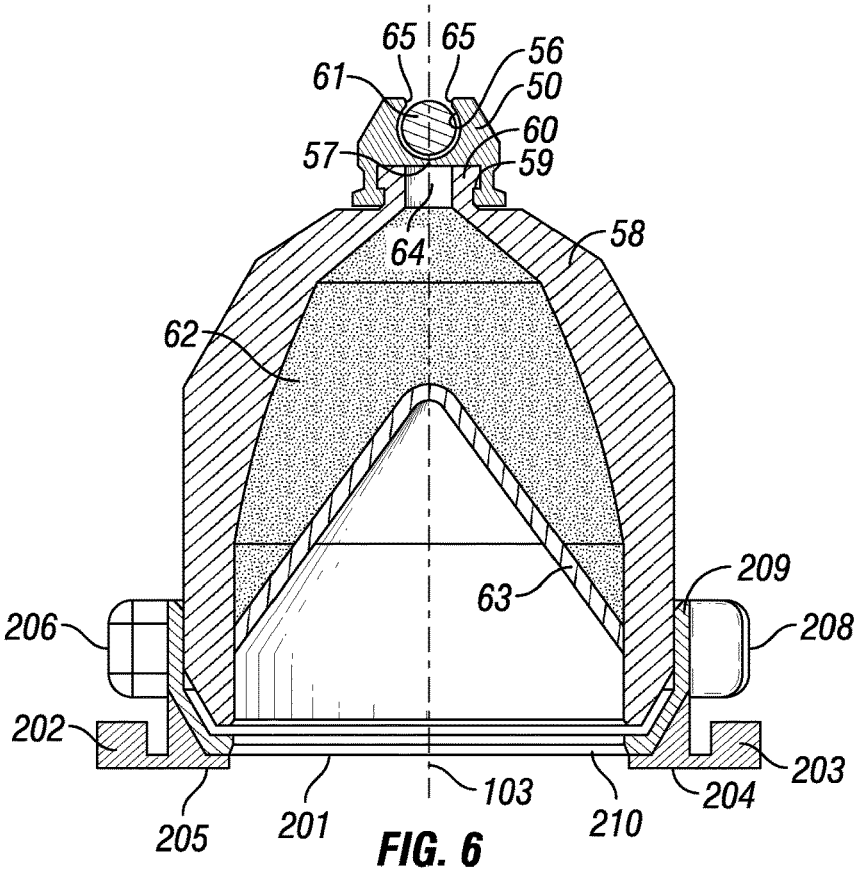
FIG. 6 is a cross-section side view of a detonating cord retainer and a locking device attached to a shaped charge case.

In FIG. 6 the shaped charge case 58 is attached to the detonating cord retainer 50. The shaped charge case 58 is machined with an apex end 60. The apex end 60 has a lip 59. The detonating cord retainer 50 snaps over the lip 59. Alternatively, the detonating cord retainer 50 could be threaded onto the shaped charge case 58, secured with adhesive, snapped around the full length of the shaped charge case 58, or formed integrally with the shaped charge case 58. The detonating cord retainer 50 could also be secured to the shaped charge case 58 using set screws, roll pins, or any other mechanical fasteners. The detonating cord 61 is snapped into the u-shaped cutout 56. In this example the detonating cord retainer 50 can freely rotate when attached to the shaped charge case 58, however a set screw or other fastening device could be used to prevent rotation if desired. When the detonating cord 61 detonates the explosion will puncture through the thin material 57 and enter thru hole 64 of the shaped charge case 58. The explosion will then interact with the explosive material 62 causing it to explode. The detonation of explosive material 62 will then transform liner 63 into a plasma jet capable of puncturing out of the perforating gun. The thin material 57 may be solid, it could also have a thru hole, perforations, a window or other aid that facilitates the explosion traveling from the detonating cord 61 to the explosive material 62. Furthermore, in this embodiment the u-shaped cutout 56 is depicted as having a gap between the two retaining ends 65, however the gap could be narrower such that the retaining ends 65 touch each other either before or after the detonating cord 61 is put into place. The detonating cord retainer 50 may be constructed of plastic using for instance an injection molding process or a rapid prototyping process. The detonating cord retainer 50 in this embodiment restricts the ability of the detonating cord 61 to move sideways, but it may allow the detonating cord 61 to move through the detonating cord retainer 50 and allows for rotation of the detonating cord 61 with respect to the shaped charge case 58.

Continuing to refer to FIG. 6, the shaped charge 12 has a shaped charge retainer device 200 attached to the open end. The shaped charge retainer device 200 has a top body portion 201 with a substantially frusto-conical shape. It has a bottom body portion 209 with a substantially cylindrical shape. Top body portion 201 and bottom body portion 209 share a common axis 103. It has a first alignment tab 208 protruding tangentially from the surface of the bottom body portion 209. It has a second alignment tab 206 protruding tangentially from the surface of the bottom body portion 209. It has a first locking tab 203 protruding from the top body portion 210. It has a second locking tab 202 protruding from the top body portion 210. The first locking tab has a flat top 204. The second locking tab 202 has a second flat top 205. The shaped charge retainer device 200 can be fixed to the shaped charge case 28 by snapping into place, set screws, adhesives, or some other well known means for affixing two object together. The shaped charge retainer device 200 may also simply sit on top of the shaped charge case 28, either loosely or rely on the friction from an interference fit.

Figure 7:
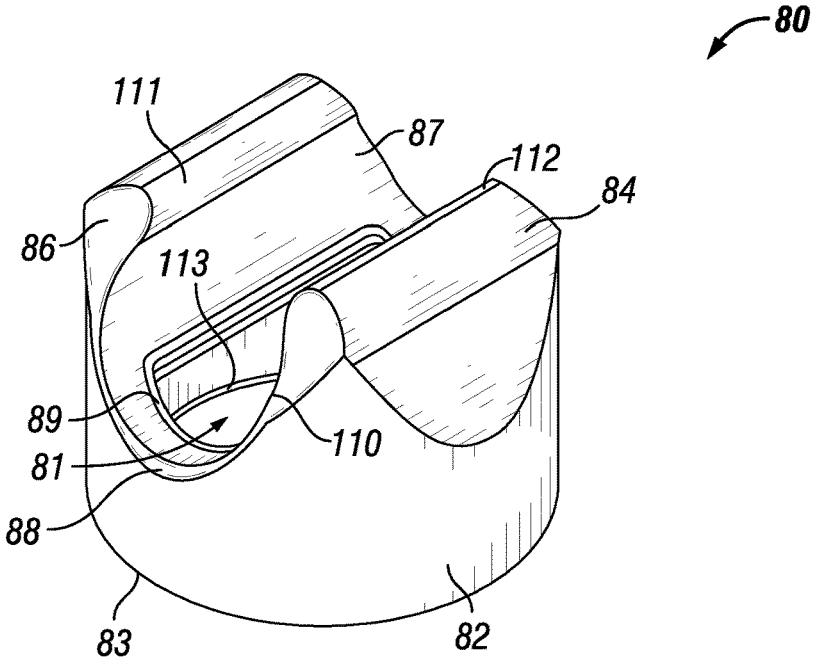
FIG. 7 is a perspective view of a detonating cord retainer.

Another example embodiment of a detonating cord retainer 80 is shown in FIG. 7. It is adapted to interface with the apex end of a shaped charge case. Detonating cord retainer 80 includes a base 82 having a bottom end 83 and a top end 88. A bore 81 extends into the base 82 from the bottom end 83. An aperture 89 in the top end 88 of the base 82 is adapted to allow detonation communication from the top end 88 of the base 82 into the bore 81. A first retention arm 86 having an inner face 87 extends substantially orthogonally from the top end 88 of the base 82. A second retention arm 84 has an inner face 110 extending substantially orthogonally from the top end 88 of the base 82. The inner face 87 of the first retention arm 86 is substantially parallel to and facing the inner face 110 of the second retention arm 84.

The inner face 87 of the first retention arm 86 has a retention nub 111 distal from the base extending toward the second retention arm 84. The first retention arm 86 and second retention arm 84 are adapted to retain a detonating cord in proximity to the aperture 89. The inner face 110 of the second retention arm 84 has a retention nub 112 distal from the base extending toward the first retention arm 86. A circumferential ridge 113 is located in the bore 81 adapted to engage a corresponding groove in a shaped charge case. The circumferential ridge 113 may also be a circumferential groove adapted to engage a corresponding ridge in a shaped charge case. The aperture 89 extends from the top end 88 of the body 82 to the bore 81. The bore 81 may extend through a portion of the top end 88 of the body 82 to form the aperture 89.

An example of a method of use may include installing a shaped charge retainer 200 onto a shaped charge 12, installing that combination into a charge tube 18, inserting a plurality of keys, in this case first alignment tab 208 and second alignment tab 206 into a plurality of key cutouts 220 located on the charge tube 18. The aligned shaped charge retainer 200 is then inserted until the keys, alignment tabs 206 and 208, are through the charge tube cutouts 220. Then the shaped charge retainer 200 is rotated or twisted about its axis after passing the plurality of keys through the plurality of corresponding keyways until snapping the a plurality of locking tabs, in this case locking tabs 202 and 203, into the plurality of cutouts 220. This process is repeated until all shaped charges 12 are installed in the charge tube 18. The charge tub is then installed in a perforating gun 10. Then perforating gun 10 is then lowered to a predetermined location with a well with the shaped charges 12 held in place by shaped charge retainers 200. The shaped charges 12 are then detonated on command. Afterwards the perforating gun 10 is removed from the well.

Although the embodiments have been described in terms of particular examples which are set forth in detail, it should be understood that this is by illustration only and that the embodiments are not necessarily limited thereto. Alternative embodiments and operating techniques will become apparent to those of ordinary skill in the art in view of the present disclosure. Accordingly, modifications of the embodiments are contemplated which may be made without departing from the spirit of the disclosure.

What is claimed is:

1. A shaped charge retainer comprising:
- a bottom ring section, being substantially cylindrical about an axis and having a first internal diameter;
- a top section, being substantially cylindrical about the axis, having a second internal diameter smaller than the first internal diameter, and being attached to and axially displaced from the bottom ring section;
- a first key protruding radially from the bottom ring section;
- a first locking tab having a cylindrical body, radially offset from the top section body, having a center axis parallel with the axis of the top section, and integral with a first flexible bridge portion protruding radially from the top section, located above the first key and offset a first twist angle about the axis from the first key;
- a second key protruding radially from the bottom ring section, positioned 180 degrees about the center of the bottom ring section from the first key; and
- a second locking tab having a cylindrical body, radially offset from the top section body, having a center axis parallel with the axis of the top section, and integral with a second flexible bridge portion protruding radially from the top section, positioned 180 degrees about the center of the top section from the second locking tab, wherein the locking keys flex as they twist about the curvature of a charge tube, engaging a plurality of keyways on the outer surface of the charge carrier, providing positive locking of the shaped charge against the charge tube.

2. The apparatus of claim 1 further comprising the shaped charge retainer being composed of nylon.

3. The apparatus of claim 1 further comprising the locking tab having a bridge portion, a tab portion, wherein the bridge portion is shorter than the tab in dimension parallel to the axis.

4. The apparatus of claim 1 further comprising the locking tab having a flush top surface adapted to be flush with a perforating charge tube.

5. The apparatus of claim 1, wherein the top section is frusto conical shaped.

6. A method for installing at least one shaped charge comprising:
- placing a shaped charge retainer having a plurality of keys on a shaped charge opening;
- inserting the shaped charge with the shaped charge retainer into a charge tube cutout;
- aligning the shaped charge retainer having a plurality of keys with a plurality of keyways in the charge tube;
- passing a plurality of keys on the shaped charge retainer through the plurality of keyways on the charge tube cutout;
- rotating the shaped charge retainer after passing the plurality of keys through the plurality of corresponding keyways;
- engaging the plurality of keys against the inner surface of the charge tube;
- engaging a plurality of locking tabs, each having a cylindrical body, radially offset from the shaped charge retainer, and integral with a flexible bridge portion, located on the shaped charge retainer against the outer surface of the charge tube;
- rotating the shaped charge retainer, thereby flexing the flexible bridge portion against the outer surface of the charge tube; and
- snapping the plurality of locking tabs into the plurality of keyways, wherein the locking tabs are positively locked into the keyways, wherein the locking tabs are positively locked into the keyways.

7. The method of claim 6 further comprising placing a u-shaped detonation cord retainer on the distal end of the shaped charge.

8. The method of claim 6 further comprising attaching a detonation cord to the shaped charge.

9. The method of claim 6 wherein the at least one shaped charge is a plurality of shaped charges being installed in a single charge tube.

10. The method of claim 6 further comprising installing the charge tube into a perforating gun.

11. The method of claim 6 further comprising running the perforating gun to a predetermined downhole location.

12. The method of claim 6 further comprising detonating the at least one shaped charge.

13. A shaped charge retention system comprising:
- a shaped charge case with an apex end and an explosive discharge end;
- a charge tube with a center axis, having a first plurality of circular cutouts adapted for interfacing with a shaped charge case apex end, a second plurality of circular cutouts located 180 degrees opposite of the first plurality of cutouts about the charge tube axis, and a pair of keyway cutouts associated with each second plurality of circular cutouts, located 180 degrees opposite of each other about the center of each of the second plurality of cutouts;
- a detonating cord;
- a shaped charge retainer further comprising:
  - a bottom ring section, being substantially cylindrical about the axis and having a first internal diameter;
  - a top section, being substantially cylindrical about the axis, having a second internal diameter smaller than the first internal diameter, and being attached to and axially displaced from the bottom ring section;
  - a first key protruding radially from the bottom ring section;
  - a first locking tab having a cylindrical body, radially offset from the top section body, having a center axis parallel with the axis of the top section, and integral with a first flexible bridge portion protruding radially from the top section, located above the first key and offset a first twist angle about the axis from the first key;

a second key protruding radially from the bottom ring section, positioned 180 degrees about the center of the bottom ring section from the first key; and a second locking tab having a cylindrical body, radially offset from the top section body, having a center axis parallel with the axis of the top section, and integral with a second flexible bridge portion protruding radially from the top section, positioned 180 degrees about the center of the top section from the second locking tab, wherein the locking keys flex as they twist about the curvature of a charge tube, engaging a plurality of keyways on the outer surface of the charge carrier, providing positive locking of the shaped charge against the charge tube.

14. The apparatus of claim 13 further comprising the shaped charge retainer being composed of nylon.

15. The apparatus of claim 13 further comprising the locking tab having a bridge portion, a tab portion, wherein the bridge portion is shorter than the tab in dimension parallel to the axis.

16. The apparatus of claim 13 further comprising the locking tab having a flush top surface adapted to be flush with a perforating charge tube.

17. The apparatus of claim 13, wherein the top section is frusto conical shaped.

18. The system of claim 13, wherein the shaped charge retainer is composed of plastic.

19. The system of claim 13, wherein the shaped charge retainer can pivot about the shaped charge in 360 degrees.

20. The system of claim 13, further comprising a plurality of shaped charges.

21. The system of claim 13, further comprising a plurality of cylindrical retainers.

* * * * *